US011629571B1

(12) United States Patent
Lane et al.

(10) Patent No.: US 11,629,571 B1
(45) Date of Patent: Apr. 18, 2023

(54) MODULAR WELL CAPPING SYSTEM, KIT, AND METHODS

(71) Applicant: Capwell Services LLC, Annandale, VA (US)

(72) Inventors: Andrew Jiesheng Lane, Annandale, VA (US); Tomas Luis Pinilla, Miami, FL (US); Lucien Christopher Peach, Wilmington, DE (US); Justin Edward Hegar, Cary, NC (US); Jacoby Niko Simpkins, Hixson, TN (US); Walter Enrique Hubsch Palacios, Sewickley, PA (US)

(73) Assignee: CAPWELL SEAVICES LLC, Annandale, VA (US)

( * ) Notice: Subject to any disclaimer, the term of this patent is extended or adjusted under 35 U.S.C. 154(b) by 0 days.

(21) Appl. No.: 18/061,925

(22) Filed: Dec. 5, 2022

(51) Int. Cl.

| | |
|---|---|
| ***E21B 33/03*** | (2006.01) |
| ***E21B 33/04*** | (2006.01) |
| ***E21B 43/34*** | (2006.01) |
| ***E21B 41/00*** | (2006.01) |

(52) U.S. Cl.
CPC ..... *E21B 33/04* (2013.01); *E21B 41/0071* (2013.01); *E21B 43/34* (2013.01); *E21B 2200/01* (2020.05)

(58) Field of Classification Search
CPC ... B01D 2257/304; Y02C 20/20; E21B 33/03; E21B 33/02; E21B 43/34
See application file for complete search history.

(56) References Cited

U.S. PATENT DOCUMENTS

| | | | | |
|---|---|---|---|---|
| 2,735,697 | A * | 2/1956 | Zanin | F16L 55/132 277/621 |
| 2,983,573 | A | 5/1961 | Moore et al. | |
| 3,186,789 | A | 6/1965 | Ward et al. | |
| 3,719,374 | A | 3/1973 | Serrano | |
| 5,830,423 | A | 11/1998 | Trocciola et al. | |
| 5,980,733 | A * | 11/1999 | Collins | C10G 29/20 208/348 |

(Continued)

FOREIGN PATENT DOCUMENTS

| | | | |
|---|---|---|---|
| CN | 108915638 | A | 11/2018 |
| CN | 110540881 | A | 12/2019 |

(Continued)

*Primary Examiner* — Kipp C Wallace
(74) *Attorney, Agent, or Firm* — PK Patent Law

(57) ABSTRACT

A transportable well capping system, kit, and methods are provided. The transportable well capping system can include a plurality of modular subsystems capable of fitting within a bed of a standard full-sized pickup truck. The modular subsystems can include a sealing mechanism subassembly including a plurality of different sized seals for securing to a range of diameters of well casings, a gas flow meter subassembly, a hydrogen sulfide scrubber subassembly, a compressor and storage subassembly capable of storing the scrubbed methane in a storage tank, and a methane destruction subassembly capable of igniting the scrubbed methane gas and converting it to carbon dioxide. The subassemblies are sized to be capable of fitting within the bed of a standard full-sized pickup truck and can be driven to a location of an abandoned well and fluidically interconnected in a manner to cap the abandoned well.

23 Claims, 5 Drawing Sheets

(56) References Cited

U.S. PATENT DOCUMENTS 7,060,233 B1 * 6/2006 Srinivas ..... B01D 53/8612 423/576.2
7,731,779 B2 6/2010 Palumbo
7,815,713 B2 10/2010 Sorensen et al.
8,480,789 B2 7/2013 Sorensen et al.
8,535,429 B2 9/2013 Grill
8,574,888 B2 11/2013 Grill
9,005,337 B2 4/2015 Grill
9,346,008 B2 5/2016 Favilli et al.
9,458,693 B1 10/2016 Matthews-Ewald et al.
10,801,872 B1 * 10/2020 Beck ..... G01F 7/00
2004/0168795 A1 * 9/2004 Owens ..... E21B 33/03 166/85.2
2009/0211766 A1 * 8/2009 Cuthill ..... E21B 34/00 166/85.1
2010/0038082 A1 * 2/2010 Zubrin ..... E21B 43/164 422/187
2012/0204599 A1 * 8/2012 Northrop ..... C10L 3/102 62/617
2012/0240650 A1 * 9/2012 Iyer ..... B01D 53/1425 95/158
2012/0264197 A1 10/2012 Mitariten
2013/0095438 A1 4/2013 Grill
2014/0366577 A1 * 12/2014 Zubrin ..... C10L 3/10 62/619
2015/0060356 A1 * 3/2015 Barry ..... C02F 3/2893 210/603
2015/0322771 A1 * 11/2015 Bourgeois ..... E03B 3/16 73/304 R
2017/0120191 A1 * 5/2017 Nurkowski ..... E21B 41/0057

FOREIGN PATENT DOCUMENTS

CN 111732980 A 10/2020
CN 112175684 A 1/2021

* cited by examiner

MODULAR WELL CAPPING SYSTEM, KIT, AND METHODS

FIELD OF THE INVENTION

The present teachings relate to a system, kit, and methods for capping abandoned fossil fuel wells. In particular, the present teachings relate to a transportable and modular system and kit for economically capping abandoned wells in remote locations to reduce environmentally harmful methane gas emissions.

BACKGROUND OF THE INVENTION

Every year abandoned oil and gas wells in the United States emit approximately 290 kilotons of methane gas into the atmosphere. Methane is a potent greenhouse gas which has about 80 times the warming power of carbon dioxide over a 20-year period. As a result, methane gas emissions from abandoned wells have a significant effect on total U.S. greenhouse gas emissions which impact global warming.

To cap an abandoned well, known solutions are expensive and time-consuming. Currently, to properly plug an abandoned well an oilfield services company must erect a rig at the well site, tear out the old casing, install a new casing, and then cement plugs above and below each rock formation inside of the well. Commonly used well plugging equipment is large, complicated, and heavy, and therefore, must be delivered using semi-trucks. Since abandoned wells are oftentimes remotely located, roads and accessways need to be built to access these wells. As a result, in the state of Pennsylvania it can cost an average of around $68,000 to properly plug a well.

As a result, abandoned wells can sit for decades without bids coming up to plug them. Once a bid is won by a contractor, they have up to 5 years from winning the bid to plug the abandoned well. In the interim, the abandoned well can emit large amounts of hazardous methane gas directly into the atmosphere. This is because regulation has been slow to catch up to the problem of hazardous well emissions and this has resulted in a lack of innovation since the 1980s in well plugging methodologies.

Accordingly, there exists a need for a cost-effective, immediate solution for eliminating well emissions from any size and any type of abandoned fossil fuel well.

SUMMARY OF THE INVENTION

The present teachings provide a transportable well capping system for securing to a well casing of an abandoned well emitting methane gas. The well capping system can include a plurality of modular subassemblies including; a sealing mechanism subassembly including a plurality of different sized seals for securing to a range of diameters of well casings; a gas flow meter subassembly capable of storing well emissions data based on readings from an emitted methane gas from the abandoned well; a hydrogen sulfide scrubber subassembly capable of receiving the emitted methane gas from the gas flow meter subassembly and scrubbing it of hydrogen sulfide; a compressor and storage subassembly capable of receiving the scrubbed methane gas from the hydrogen sulfide scrubber subassembly and storing it in a storage tank; and a methane destruction subassembly capable of receiving the stored methane gas from the storage tank and igniting it to convert the methane gas to carbon dioxide. The transportable well capping system can be sized to fit within the bed of a standard full-sized pickup truck.

The present teachings also provide an on-site well capping kit including a plurality of modular subassemblies capable of capping an abandoned well emitting a methane gas including hydrogen sulfide. The kit can include; a sealing mechanism subassembly including a plurality of different sized seals for securing to a range of well casing diameters; a gas flow meter subassembly capable of storing well emissions data based on readings of the emitted methane gas from the abandoned well; a hydrogen sulfide scrubber subassembly capable of scrubbing the methane gas of hydrogen sulfide; a compressor and storage subassembly capable of storing the scrubbed methane gas in a storage tank; and a methane destruction subassembly capable of receiving the stored scrubbed methane gas and igniting it to convert it to carbon dioxide. The plurality of modular subassemblies can be capable of being fluidically interconnected with each other on-site of the abandoned well.

The present teachings still further provide a method of capping an abandoned well that emits a methane gas including hydrogen sulfide. The method includes loading a plurality of modular subsystems into a bed of a standard full-sized pickup truck. The plurality of modular subsystems can include a sealing mechanism subassembly including a plurality of different sized seals for securing to a well casing of various diameters; a gas flow meter subassembly capable of storing well emissions data based on readings of the emitted methane gas from the abandoned well; a hydrogen sulfide scrubber subassembly capable of scrubbing the methane gas of hydrogen sulfide; a compressor and storage subassembly capable of storing the scrubbed methane gas in a storage tank; and a methane destruction subassembly capable of receiving the stored scrubbed methane gas and igniting it to convert it to carbon dioxide. The method further includes driving the truck to a location of an abandoned well and capping the abandoned well by fluidically interconnecting a portion of the plurality of modular subsystems to a well casing of the abandoned well.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only and are intended to provide an explanation of various embodiments of the present teachings.

DETAILED DESCRIPTION OF THE PREFERRED EMBODIMENTS

The present teachings relate to a transportable well capping system 100 that includes a plurality of interconnectable subsystems that are capable of readily securing to any abandoned fossil fuel well no matter how remote its location. The well capping system 100 helps reduce greenhouse gas emissions by collecting methane emitted from the surface of the abandoned well and processing it to reduce the well's greenhouse gas emissions. The well capping system 100 can also generate and store energy from the combustion of the collected methane. The well capping system 100 of the present teachings can process the emitted methane and turn it into carbon dioxide which possesses an atmospheric warming potential that is 80 times lower compared to methane.

The well capping system 100 of the present teachings is a modular system that can encompass a kit including a plurality of interconnectable subsystems that are sized to be readily transportable by way of a standard, full-sized pickup truck. The kit of interconnectable subsystems can be driven to the site of any abandoned well and then installed by interfacing with each other in a modular manner. By delivering the plurality of interconnectable subsystems to the location of the abandoned well using a standard, full-sized pickup truck, the well capping system 100 of the present teachings allows a customized well cap solution to be constructed on site based on the specific characteristics of the well to be capped. To ensure easy transportation to any remote location, the entire well capping system and kit 100, when disassembled, is sized to fit in the bed of a standard, full-sized pickup truck (approximately 6 feet by 4 feet) as will be described in more detail below. Moreover, once installed on an abandoned well, the well capping system and kit 100 can be a self-contained unit and can be self-powering.

The well capping system 100 of the present teachings can provide a medium to short term stop gap solution until the abandoned well can be permanently plugged. However, the well capping system 100 of the present teachings can also provide a long-term well capping solution if routine maintenance of the subsystems is provided.

Figure 1:
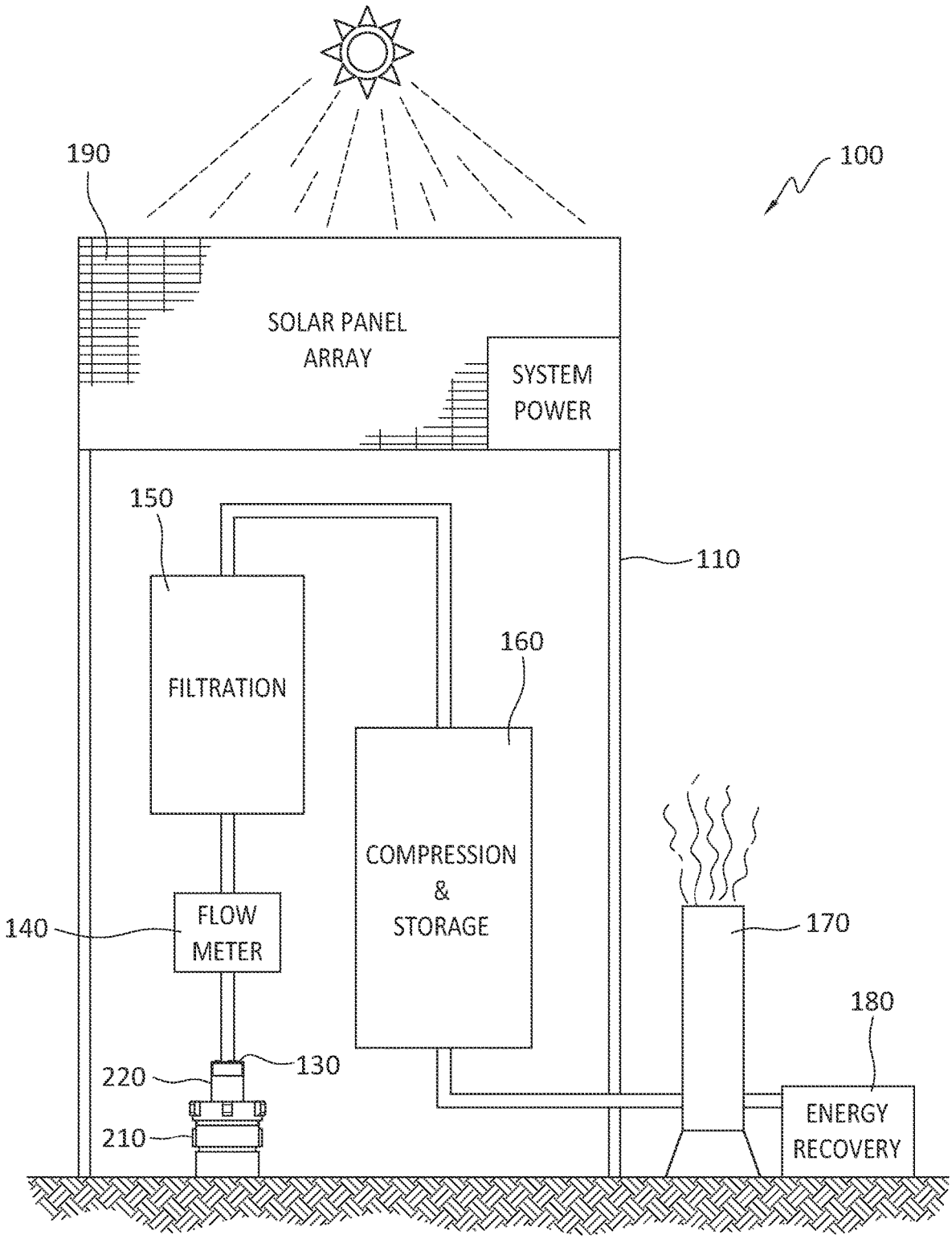
FIG. 1 shows a schematic drawing of the subsystems making up the well capping system and kit of the present teachings.

Referring to FIG. 1, the well capping system 100 of the present teachings can include the following main interchangeable subsystems/subassemblies: a sealing mechanism subassembly 130, a gas flow meter subassembly 140, a hydrogen sulfide (H2S) scrubber subassembly 150, a compressor and storage subassembly 160, a methane destruction subassembly 170, an optional energy recovery subassembly 180, and a system power and control subassembly 190.

As will be discussed in more detail below, the subsystems of the well capping system 100 can include a range of sizes and each can be designed to interface with the other subsystems in a modular manner so that abandoned wells of any size and type can be properly served on site. The subsystems making up the entire well capping system and kit 100, when disassembled, can be arranged to fit in the bed of a standard full-sized pickup truck. This allows easy transportation of the well capping system 100 to any remote location.

The bed of a standard, full-sized pickup truck can vary from manufacturer to manufacturer. A standard bed length can vary from about 6 feet, 4.3 inches to about 6 feet, 7.8 inches and a standard bed width that can vary from about 4 feet, 10.7 inches to about 5 feet, 10.7 inches. As can be seen, while there is some variation in bed lengths and widths, the dimensions of a standard bed do not vary much in modern pickup trucks. These bed dimensions are based on a 2021 FORD F150, 2022 DODGE RAM 1500, 2022 GMC SIERRA, 2022 CHEVROLET SILVERADO 1500, and the 2022 TOYOTA TUNDRA, which includes a range of manufacturers.

Figure 2:
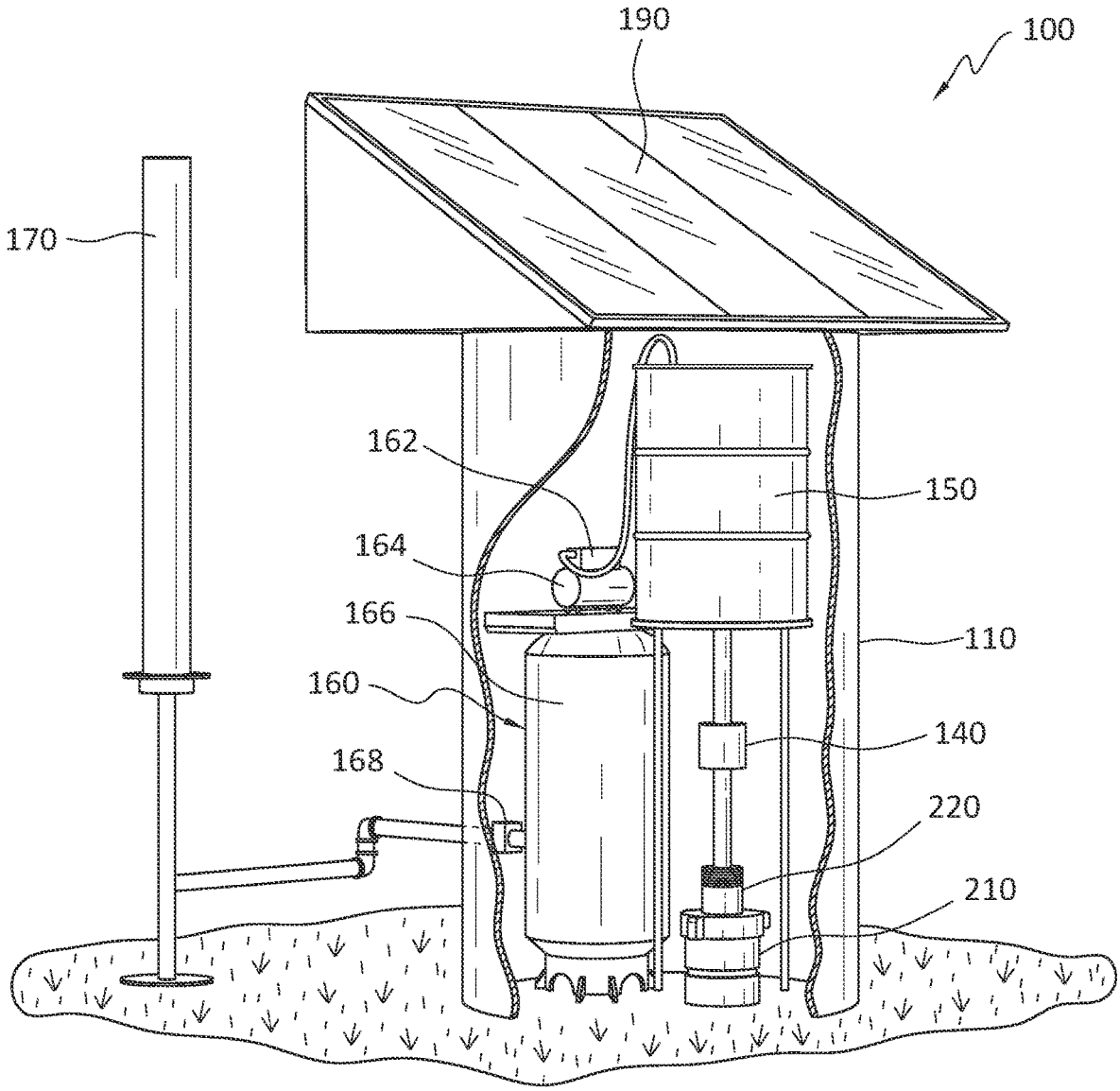
FIG. 2 shows a perspective view of the well capping system and kit of the present teachings as installed in the field.

As shown in FIG. 2, when fully installed on a well casing 220 of an abandoned well, some of the subsystems of the well capping system 100 can be housed or contained in a containment vessel 110. For example, the containment vessel 110 can be made from a sheet metal material or any other rigid material. The containment vessel 110 can be implemented for security reasons since many well locations are remote and subject to wildlife, outside contaminants, thievery, and the like.

The well capping system 100 of the present teachings can interact or secure to a well casing 220 of any abandoned well. Moreover, as will be disclosed in more detail below, the well capping system 100 can generally sit on top of the well casing 220.

Figure 3:
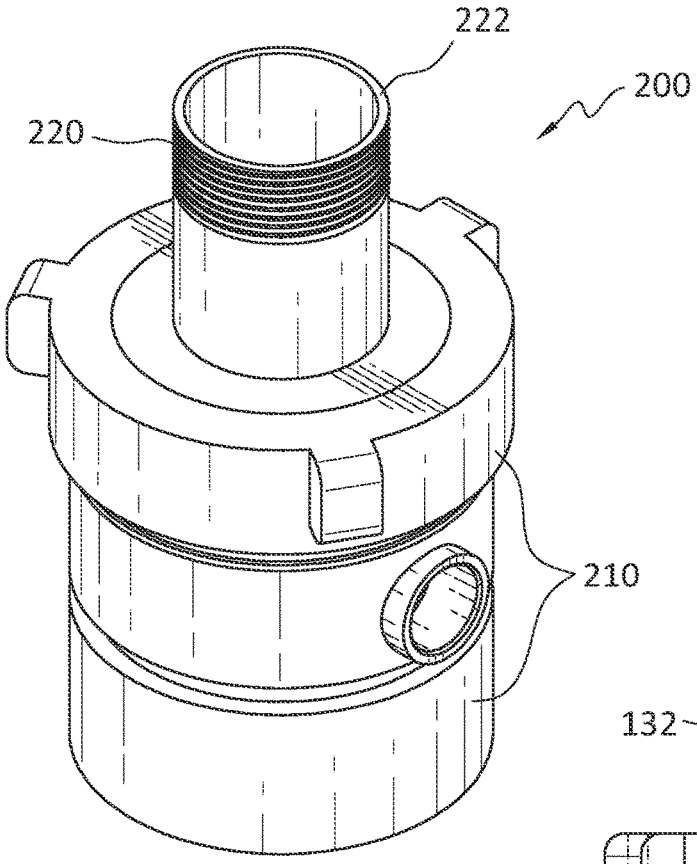
FIG. 3 shows a perspective view of a typical legacy well head structure.

Referring to FIG. 3, a well casing 220 is shown as part of a legacy well head structure 200. The well casing 220 is the tubing that sticks out of the ground that is left over when a well is abandoned. The well casing 220 is shown extending from a well head 210 and includes a lip 222 at its exposed end.

Figure 4:
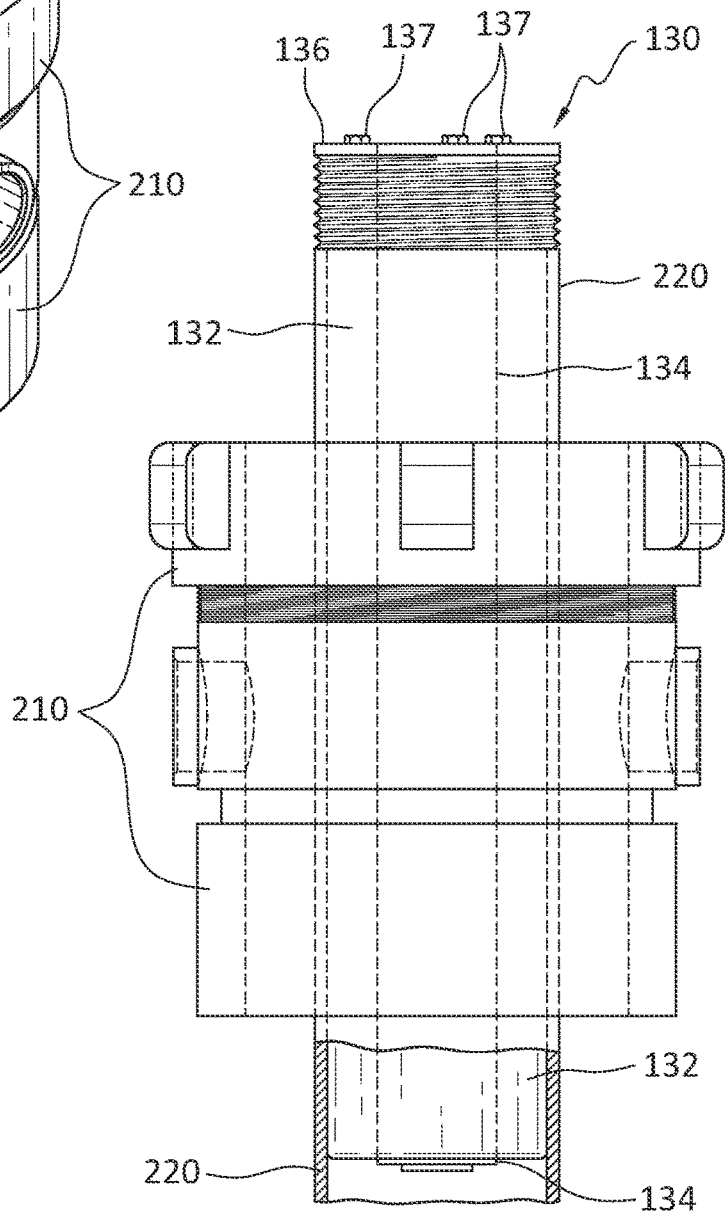
FIG. 4 shows a side view of a sealing mechanism subassembly of the present teachings installed in a well head structure of an abandoned well.
Figure 5:
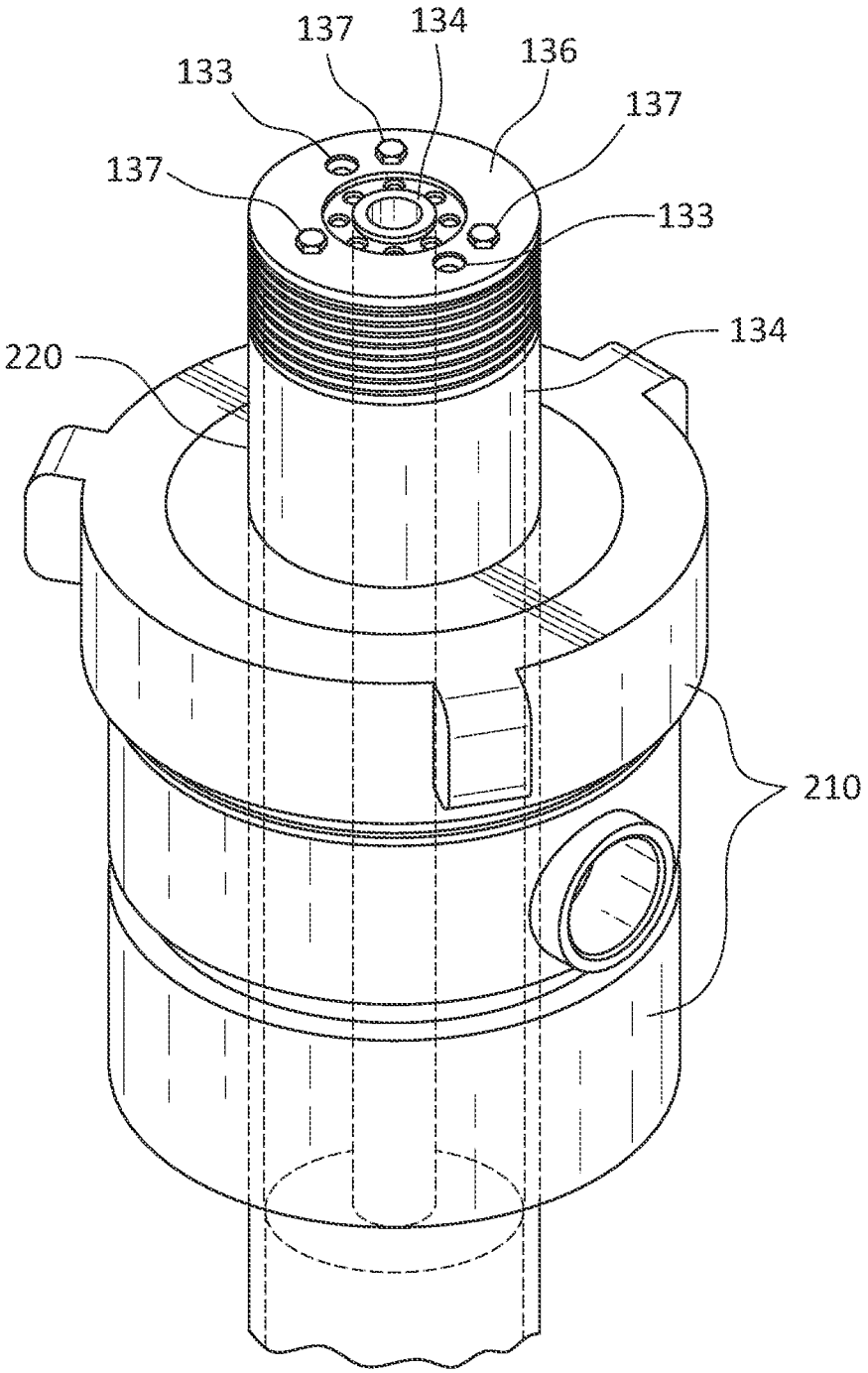
FIG. 5 shows a perspective view of the installation of FIG. 4.

Referring to FIGS. 4 and 5, the sealing mechanism subassembly 130 of the well capping system 100 of the present teachings can fit within and secure to any abandoned well casing 220. The sealing mechanism subassembly 130 can include one or more inflatable bladders 132 that can be sized to seal a range of well casing diameters. However, any other type of adjustable sealing mechanism 132 could be implemented for adjustably sealing against an inner wall of a well casing 220 to create a gas seal. The sealing mechanism subassembly 130 can also include a pipe 134 that can be centrally arranged with respect to the inflatable bladder 132. The inflatable bladder 132 and the pipe 134 form a bypass plug 130. When the bypass plug 130 is installed as a seal against the interior of a well casing 220, the pipe 134 operates to direct emitted methane upwardly through the center of the bladder 132 and into the downstream components of the well capping system 100 where it can be contained and processed into carbon dioxide as will be discussed in more detail below.

The adjustable sealing mechanism or inflatable bladder 132 can be made from any resilient material which is resistant to methane and hydrogen sulfide, the main emissions from abandoned wells. For example, the inflatable bladder 132 can be made from neoprene, nitrile rubber, and the like.

The well capping system 100 of the present teachings can target abandoned wells known as super emitters which are defined as those that release greater than approximately 0.9 tons of methane per year. Although there are certain types of wells that are predisposed to emit more than average amounts of methane (such as newer natural gas wells), any type of abandoned well can be considered a super emitter.

Since different types of wells can be super emitters, the sealing mechanism subassembly 130 of the well capping system 100 of the present teachings includes a plurality of sizes that can cover the entire range of possible diameters of well casings 220 that can be found once on-site. For example, the sealing mechanism subassembly 130 can include seal mechanisms capable of sealing inner diameters as small as about 4.625 inches to an inner diameter as large as about 32 inches. For example, the sealing mechanism subassembly 130 can include four seal sizes which can completely cover the range of possible well casing 220 inner diameters. The four sizes can include, in increasing size order, from about 4" to about 8", from about 8" to about 16 inches, from about 14 inches to about 24 inches, and from about 20 inches to about 40 inches. These variants of sealing devices 132 can support different internal bypass pipe 134 diameters. For example, a 4-8 inch bladder 132 can have an internal pipe size of 1 inch, while the 8-16 inch, 14-34 inch, and 20-40 inch bladders 132 can have an internal pipe size of 2 inches.

As shown in FIGS. 4 and 5, a plate 136 can be secured to the top of the sealing mechanism subassembly 30. A series of bolts 137 can be used to secure the plate 136 to the adjustable sealing mechanism 132 (e.g. the inflatable bladders). In addition, one or more apertures 133 can be arranged in the plate to allow air access for allowing inflation of the bladders 132.

The plate 136 can be sized to sit on the top lip 222 of the well casing 220. In this manner, the weight of the sealing mechanism subassembly 130 and other subsystems of the well capping system 100 can rest on the plate 136, and in turn the well casing 220, rather than relying solely on frictional support between the sealing mechanism 132 and well casing 220. The plate 136 can prevent the sealing mechanism subassembly 130 from slipping down the well casing 220 while allowing easy deflation and removal of the sealing mechanism subassembly 130 from the well casing 220. The plate 136 can be made of a metallic material, such as aluminum or steel.

Figure 6:
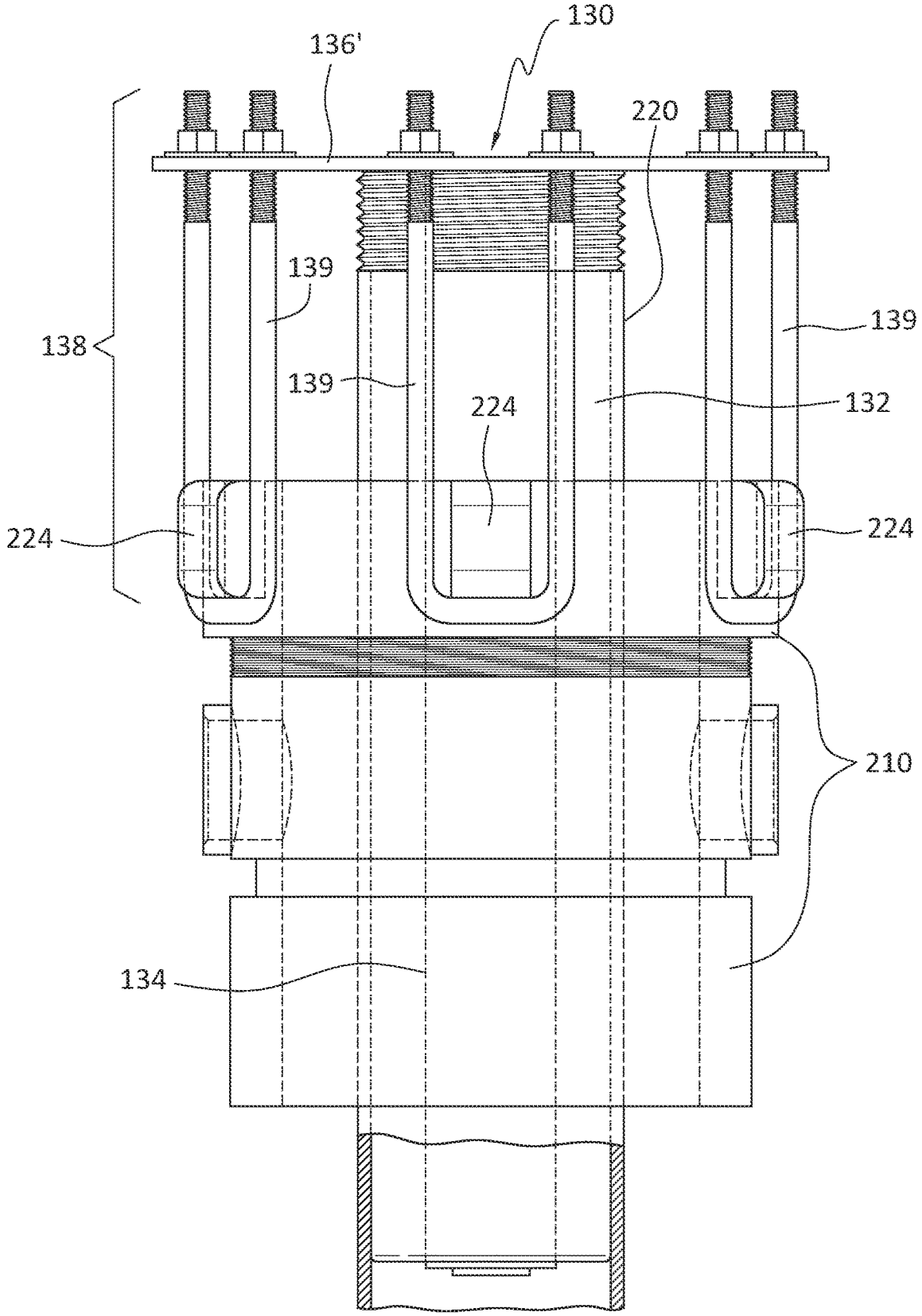
FIG. 6 shows a side view of a fastening mechanism for the sealing mechanism subassembly.

Referring now to FIG. 6, an additional fastening mechanism 138 can be provided to prevent excess pressure buildup from blowing out the sealing mechanism subassembly 130 (and the rest of the well capping system 100) from an abandoned well. The additional fastening mechanism 138 can include a series of U-bolts 139 that can be used to secure a large diameter plate 136' to the wellhead 210. More particularly, the additional fastening mechanism 138 can include a series of U-bolts 139 that can hook about corresponding extrusions or tabs 224 formed in the wellhead 210 while the opposite ends of the U-bolts 139 can be secured to the plate 136' via nuts. However, any other additional fastening mechanism can be implemented depending on the style and condition of the wellhead 210.

Referring to FIGS. 1 and 2, from the sealing mechanism subassembly 130 of the well capping system 100, the emitted methane gas can flow vertically upwards into and through the gas flow meter subassembly 140. Among other readings, the gas flow meter subassembly 140 can provide and store well emissions data based on readings of the emitted methane gas from the abandoned well, as will be discussed in more detail below.

The gas flow meter subassembly 140 can include a self-contained unit with its own power source and data logging equipment. According to various embodiments, the gas flow meter subassembly 140 can stand adjacent to but independent from the system power and control subassembly 190.

After flowing through the gas flow meter subassembly 140, the emitted methane gas is directed to one or more hydrogen sulfide (H2S) scrubber subassemblies 150. A hydrogen sulfide (H2S) scrubber subassembly 150 can include any container or tank packed with a hydrogen sulfide removal adsorbent that can scrub the emitted methane gas of hydrogen sulfide. Such a hydrogen sulfide removal adsorbent can be steel wool that utilizes a reaction between ferric (III) oxide and hydrogen sulfide to scrub the emitted methane gas. The hydrogen sulfide scrubber subassembly 150 "cleans" the emitted methane gas of hydrogen sulfide (i.e. scrubs out toxic byproduct which yields raw sulfur). According to various embodiments, the hydrogen sulfide scrubber subassembly 150 can utilize any other hydrogen sulfide removal adsorbent, such as SULFATREAT.

As shown in FIG. 2, a hydrogen sulfide (H2S) scrubber subassembly 150 can include a container supported on an elevated platform directly above the gas flow meter subassembly 140. This will allow the full weight of the scrubber subassembly 150 to be supported by the platform rather than by the gas flow meter subassembly 140. The emitted methane gas will then rise through the container while being scrubbed of hydrogen sulfide as it rises.

As the scrubbed methane gas exits from the outlet of the scrubber container, it can be directed to another scrubber container incorporating the same or another scrubbing process, or it can be directed to proceed to the compressor and storage subassembly 160. The number of scrubbers depends on the amount of hydrogen sulfide content that is being emitted from the abandoned well. If a second scrubber is used, the first scrubber can be placed on the ground next to the wellhead 210 on a much shorter platform to give access to the inlet on the underside of the container. The second scrubber can then be vertically oriented above the wellhead 210 and the sealing mechanism subassembly 130 to minimize the footprint on the ground. If only one scrubber is used, it can be oriented on the platform vertically above the sealing mechanism subassembly 130 and the gas flow meter subassembly 140.

After being scrubbed clean of hydrogen sulfide, the scrubbed methane gas can then enter a compressor and storage subassembly 160 that can compress and store the methane gas. In use, a compressor 162 pulls any remaining emitted methane gas through the well capping system 100 that is not transported to the well head 210 by natural pressure driven travel. The compressor and storage subassembly 160 can include an off-the-shelf compressor 162 and motor 164, such as one with a 1 horsepower electric motor and that is preferably explosion-proof rated.

The compressor and storage subassembly 160 can be implemented in abandoned wells that cannot sustain constant flaring due to their low methane emissions (which is most wells). In such a low methane gas emitting well, the storage tank 166 stores the scrubbed methane gas for further processing, such as by flaring on a duty cycle by a methane destruction subassembly 170.

In a high methane gas emitting well, the compressor and storage subassembly 160 can be bypassed in favor of a direct flare methane destruction subassembly 170.

Alternatively, the scrubbed methane gas can be captured, compressed, and stored in large volumes allowing it to be refined or sold on the open market.

Since it can be desirable to only activate the methane destruction subassembly 170 twice a day (every 12 or so hours), an external 60-gallon storage tank 166 can be implemented. This can be an off-the-shelf component and is known as an air storage/surge tank. Depending on the remoteness of the abandoned well to be capped, destruction can occur more often (every 6 hours) and thus a 30-gallon tank can be implemented. These timing examples are calculated using an average super emitter well (i.e. 0.9 tons of methane per year). The compressor 162 and motor 164 can be mounted on top of the storage tank 166 and can be arranged to fill the storage tank 166 directly. This is dependent not only on well location but also on well emissions. If a particular well emits significantly more methane gas, a larger storage tank or multiple tanks can be implemented for temporary storage purposes.

A valve 168 can be arranged downstream of the storage tank 166 to control the release of the scrubbed methane to the methane destruction subassembly 170. The valve 168 can be a smart valve controlled by a solenoid. A sensor can monitor the pressure inside the storage tank 166 and can be programmed to open the solenoid valve 168 when a predetermined internal pressure is reached, such as, for example, 120 psi. As will be discussed in more detail below, the valve 168 and sensor can be controlled by the system power and control subassembly 190.

The methane destruction subassembly 170 receives the scrubbed methane gas and ignites it which converts the methane to carbon dioxide (CO2) which is 80 times less harmful to the atmosphere than methane. The methane destruction subassembly 170 can be a flare, a gas generator, or a gas turbine pending on the application and the composition of the emitted methane gas. A flare can constitute a general-purpose use as it can accommodate nearly any gas composition and still destroy methane with up to 98% efficiency.

The methane destruction subassembly 170 can be a self-contained unit and can include its own power source. If a flare is used as the methane destruction subassembly 170, it can be placed outside the containment vessel 110. A flame arrestor can be arranged along the inlet line to prevent any backflow of flame and mitigate the risk of combustion of the compressed methane gas in the compressor and storage subassembly 160.

Referring to FIG. 1, the energy recovery subassembly 180 can operate to capture the useable work from the methane destruction subassembly 170. The form of the energy recovery subassembly 180 is dependent on the methane destruction subassembly 170.

If a flare is implemented as the methane destruction subassembly 170, the energy recovery subassembly 180 could be an array of thermoelectric generators (TEGs) that can charge a bank of batteries.

If a gas turbine or gas generator are implemented as the methane destruction subassembly 170/180, it can output electricity on its own which can be used to charge a bank of batteries. From there, any number of useful tasks can be accomplished via utilization of this energy, including but not limited to bitcoin mining, hydrolysis of water, direct sale to the grid, boosting cell signal, running a hydrogen generation system, running IoT nodes, and the like.

The well capping system 100 of the present teachings can include a system power and control subassembly 190. The system power and control subassembly 190 can include a set of solar panels, a bank of rechargeable batteries, and a programmable central processing unit. For an average super emitter well, the system power and control subassembly 190 can include a single battery (for example, an Eco Flow Delta Max battery or similar) and a solar panel (for example, a 400 W solar panel or similar). The solar panel can be arranged on the top of the containment vessel 110 while the battery can be arranged within the containment vessel 110. Depending on the energy needs of the abandoned well and its geographic location, additional batteries or solar panels can be implemented.

The system power and control subassembly 190 can be arranged to power the compressor 162, the solenoid valve 168 that controls when gas escapes from the storage tank 166, various sensors, and the programmable central processing unit and any other of the subassemblies. The programmable central processing unit can also include storage for logging whatever data is produced by the well capping system 100 of the present teachings.

During operation of the well capping system 100 of the present teachings, the data received from the gas flow meter subassembly 140 can be used in two ways. A primary function can be to measure the flow of gas into the well capping system 100. This can allow the central processing unit to know when to turn on the compressor 162 and how long to draw methane gas out of the system and into the storage tank 166. The data can also be used in conjunction with a methane concentration by volume sensor so that the exact quantity of methane entering the storage tank 162 can be determined and from there, a calculation made when to flare. A secondary function of the gas flow meter subassembly 140 is logging flow for carbon credit purposes. This logging can be done in a couple of 24 hour cycles and can be uploaded via a cell signal to the cloud with GPS coordinates. Alternatively, an external flow meter can be installed that manually logs flow without requiring cell connectivity.

As shown in FIG. 2, the containment vessel 110 can enclose the top and sides of the subsystems of the well capping system 100 of the present teachings (except for portions or all of the methane destruction subassembly 170 and the system power and control subassembly 190). The containment vessel 110 can include a bottom that can include threaded holes to fasten the compressor and storage subassembly 160 down, as well as to support any skeletal structures. This provides security for the well capping system 100 and a more aesthetically pleasing look compared to an exposed system. The containment vessel 110 can be constructed from sheet metal and can be capable of supporting the solar arrays of the system power and control subassembly 190.

The well capping system 100 of the present teachings, with its modularity, is capable of being quickly and cost-effectively installed on any abandoned well having any gas quality and quantity. The relatively small size and modularity of the subsystems of the well capping system 100 is a great advantage over current well plugging methods which require a mobile rig mounted on a semi-truck to be erected over the abandoned well. The well capping system 100 of the present teachings costs less than plugging a well with concrete, is more transportable (designed to fit within the bed of a standard bed pickup truck) and can be adapted to any well situation once the well capping system 100 has been driven to the well site.

As such, the present teachings also define a method of capping an abandoned well. The method can include loading a plurality of modular subsystems into a bed of a standard full-sized pickup truck and driving the truck to a location of an abandoned well, and capping the abandoned well by fluidically interconnecting a portion of the plurality of modular subsystems to a well casing of the abandoned well.

The well capping system, kit, and methods of the present teachings can effectively contain and destroy methane from the surface of a well, with the bonus of obtaining useful work from this process. The destruction of methane is important because methane is a powerful greenhouse gas that is about 80 times more potent than CO2 over the span of 20 years and 20 times more potent over 100 years. The 290 kilotons emitted yearly from over 2 million abandoned wells leads to a significant impact on the nation's greenhouse gas emissions which impacts global warming.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A transportable well capping system for securing to a well casing of an abandoned well emitting methane gas, the well capping system including a plurality of modular subassemblies comprising:

a sealing mechanism subassembly including a plurality of different sized seals for securing to a range of diameters of well casings;

a gas flow meter subassembly configured to store well emissions data based on readings from an emitted methane gas from the abandoned well;

a hydrogen sulfide scrubber subassembly configured to receive the emitted methane gas from the gas flow meter subassembly and scrub it of hydrogen sulfide;

a compressor and storage subassembly configured to receive the scrubbed methane gas from the hydrogen sulfide scrubber subassembly and store it in a storage tank; and a methane destruction subassembly configured to receive the stored methane gas from the storage tank and ignite it to convert the methane gas to carbon dioxide;

wherein the transportable well capping system is sized to fit within the bed of a standard full-sized pickup truck.

2. The transportable well capping system of claim 1, wherein the sealing mechanism subassembly includes a plurality of different sized inflatable bladders.

3. The transportable well capping system of claim 1, wherein the sealing mechanism subassembly includes a plurality of different sized seals capable of sealing well casings having an inner diameter range of from about 4 inches to about 32 inches.

4. The transportable well capping system of claim 1, wherein the hydrogen sulfide scrubber subassembly includes a container packed with a hydrogen sulfide removal adsorbent.

5. The transportable well capping system of claim 1, wherein the hydrogen sulfide scrubber subassembly includes a first container capable of scrubbing the emitted methane gas of hydrogen sulfide and a second container providing a second stage of scrubbing the emitted methane gas of hydrogen sulfide.

6. The transportable well capping system of claim 1, wherein the methane destruction subassembly includes a flare for igniting the stored methane gas.

7. The transportable well capping system of claim 1, wherein the methane destruction subassembly includes one of a gas turbine and a gas generator capable of generating electricity.

8. The transportable well capping system of claim 7, further including an energy recovery subassembly including a battery capable of storing the electricity generated from the one of a gas turbine and a gas generator.

9. The transportable well capping system of claim 1, further including a system power and control subassembly capable of generating power to run the well capping system.

10. The transportable well capping system of claim 1, further including a containment vessel capable of being arranged to surround the plurality of modular subsystems.

11. A combination, comprising;

a standard full-sized pickup truck including a bed; and the transportable well capping system of claim 1 disposed in the bed of the pickup truck.

12. An on-site well capping kit including a plurality of modular subassemblies configured to cap an abandoned well emitting a methane gas including hydrogen sulfide, the kit comprising:

a sealing mechanism subassembly including a plurality of different sized inflatable bladders for securing to a range of well casing diameters;

a gas flow meter subassembly configured to store well emissions data based on readings of the emitted methane gas from the abandoned well;

a hydrogen sulfide scrubber subassembly configured to scrub the methane gas of hydrogen sulfide;

a compressor and storage subassembly configured to store the scrubbed methane gas in a storage tank; and a methane destruction subassembly configured to receive the stored scrubbed methane gas and ignite it to convert it to carbon dioxide;

wherein the plurality of modular subassemblies are configured to be fluidically interconnected with each other on-site of the abandoned well.

13. The onsite well capping kit of claim 12, wherein the plurality of modular subassemblies are sized to fit within the bed of a standard full-sized pickup truck.

14. The onsite well capping kit of claim 12, further including a system power and control subassembly capable of generating power to run the well capping kit.

15. The onsite well capping kit of claim 14, further including a containment vessel capable of being arranged to surround the plurality of modular subassemblies and support the system power and control subassembly.

16. The onsite well capping kit of claim 12, wherein the hydrogen sulfide scrubber subassembly includes a container packed with a hydrogen sulfide removal adsorbent.

17. The onsite well capping kit of claim 12, wherein the methane destruction subassembly includes a flare for igniting the stored scrubbed methane gas.

18. The onsite well capping kit of claim 12, wherein the methane destruction subassembly includes one of a gas turbine and a gas generator capable of generating electricity.

19. A combination comprising;

a standard full-sized pickup truck including a bed; and the on-site well capping kit of claim 12 disposed in the bed of the pickup truck.

20. A method of capping an abandoned well that emits a methane gas including hydrogen sulfide, the method comprising:

loading a plurality of modular subsystems into a bed of a standard full-sized pickup truck, the plurality of modular subsystems including:

a sealing mechanism subassembly including a plurality of different sized seals for securing to a well casing of various diameters;

a gas flow meter subassembly configured to store well emissions data based on readings of the emitted methane gas from the abandoned well;

a hydrogen sulfide scrubber subassembly configured to scrub the methane gas of hydrogen sulfide;

a compressor and storage subassembly configured to store the scrubbed methane gas in a storage tank; and a methane destruction subassembly configured to receive the stored scrubbed methane gas and ignite it to convert it to carbon dioxide;

driving the truck to a location of an abandoned well; and capping the abandoned well by fluidically interconnecting a portion of the plurality of modular subsystems to a well casing of the abandoned well.

21. The method of capping an abandoned well of claim 20, wherein the plurality of modular subsystems further includes a system power and control subassembly capable of generating power.

22. The method of capping an abandoned well of claim 20, wherein the methane destruction subassembly includes a flare for igniting the stored scrubbed methane gas.

23. The method of capping an abandoned well of claim 20, wherein the methane destruction subassembly includes one of a gas turbine and a gas generator capable of generating electricity.

* * * * *